United States Patent [19]

VanRens

[11] Patent Number: 5,018,568

[45] Date of Patent: May 28, 1991

[54] LOST FOAM ENGINE BLOCK PATTERN

[75] Inventor: Russell J. VanRens, Milwaukee, Wis.

[73] Assignee: Outboard Marine Corporation, Waukegan, Ill.

[21] Appl. No.: 306,245

[22] Filed: Feb. 2, 1989

Related U.S. Application Data

[63] Continuation of Ser. No. 202,212, Jun. 3, 1988, abandoned.

[51] Int. Cl.[5] ..... B22C 7/02; B22C 9/04

[52] U.S. Cl. ..... 164/34; 164/246; 164/249

[58] Field of Search ..... 164/34, 35, 36, 45, 164/137, 245, 246, 249, 339, 340, 342; 249/61, 62, 63, 144, 145; 425/DIG. 12, DIG. 58

[56] References Cited

U.S. PATENT DOCUMENTS

| | | | |
|---|---|---|---|
| Re. 31,488 | 1/1984 | Trumbauer | 164/34 |
| 4,243,093 | 1/1981 | Nieman | 164/34 |
| 4,632,169 | 12/1986 | Osborn et al. | 164/34 |
| 4,640,333 | 2/1987 | Martin | 164/246 |
| 4,657,063 | 4/1987 | Morris | 164/45 |
| 4,673,023 | 6/1987 | Winston | 164/45 |
| 4,691,754 | 9/1987 | Trumbauer et al. | 164/34 |
| 4,721,149 | 1/1988 | Hesterberg et al. | 164/246 |

FOREIGN PATENT DOCUMENTS 685857 1/1953 United Kingdom .

*Primary Examiner*—Richard K. Seidel
*Attorney, Agent, or Firm*—Michael, Best & Friedrich

[57] ABSTRACT

A lost foam pattern for an engine block includes a cylinder and an axially extending transfer passage defined by spaced side walls and an inner wall which is outwardly convex. The pattern further includes a first pattern piece including a wall defining a portion of a cylindrical bore having an axis, and a passage recess extending in the direction of the axis of the cylindrical bore and communicating with the cylindrical bore, which passage recess is defined by opposed walls extending axially with respect to the cylindrical bore and forming the spaced side walls of the transfer passage, a second pattern piece located in the passage recess, having a first arcuate wall forming a continuation of the cylindrical bore portion in the first pattern piece, having a second arcuate wall forming the inner wall of the transfer passage and being outwardly convex, and additional recesses and portions on the first and second pattern pieces for locating the pattern pieces relative to each other and for preventing relative movement therebetween except in the direction opposite the direction of assembly of the pattern pieces.

13 Claims, 1 Drawing Sheet

LOST FOAM ENGINE BLOCK PATTERN

This is a continuation of U.S. Ser. No. 202,212 filed June 3, 1988 now abandoned.

RELATED APPLICATIONS

This application is related to my following co-pending applications:

U.S. Ser. No. 202,970 Filed: June 3, 1988 Entitled "Lost, Foam Pattern Assembly For V-Block Engine" now allowed;

U.S. Ser. No. 202,693 Filed: June 3, 1988 Entitled "Lost Foam Casting Assembly" now abandoned;

U.S. Ser. No. 202,876 Filed: June 3, 1988 Entitled "Die Member For Forming A Lost Foam Pattern" now U.S. Pat. No. 4,872,637;

U.S. Ser. No. 202,489 Filed: June 3, 1988 Entitled "Lost Foam Transfer Passage Cavity Construction" now U.S. Pat. No. 4,880,047.

BACKGROUND OF THE INVENTION

The invention generally relates to lost foam patterns for two-stroke engine blocks including a cylinder having an axis. More particularly, the invention relates to arrangements for providing such a lost foam engine block pattern with a transfer passage having an arcuate outer wall which is concave in a plane parallel to a plane extending from and containing the cylinder axis, having an arcuate inner wall which is convex in cross section in a plane parallel to a plane extending radially from and containing the cylinder axis, and having two generally axially extending walls joining the inner and outer arcuate walls.

Attention is directed to the following United States Patents:

| | | |
|---|---|---|
| 4,243,093 | Neiman, J. R. | January 6, 1981 |
| 4,632,169 | Osborn, H. L. | December 30, 1986 |
| 4,640,333 | Martin, et al. | February 3, 1987 |
| 4,657,063 | Morris, R. L. | April 14, 1987 |
| 4,691,754 | Trumbauer, et al. | September 8, 1987 |
| 4,721,149 | Hesterberg, et al. | January 26, 1988 |
| Re.31,488 | Trumbauer | January 10, 1984 |

In the past, such transfer passages as described above were provided by forming the lost foam engine block pattern from three slices or pieces as shown generally in the Osborn U.S. Pat. No. 4,632,169, issued Dec. 30, 1986. In FIGS. 1 and 2 herein, the three pieces are identified by the numerals 11, 13, and 15 and the transfer passage is identified by the numeral 17. The inner and outer arcuate walls of the transfer passages are identified by the reference numerals 19 and 21. As shown, the transfer passage includes portions 31, 33, and 35, respectively located in each of the pattern portions or pieces 11, 13, and 15. The portion of the transfer passage in the piece or pattern portion 11 was provided by a die member which opened in the axial direction A. The transfer passage portion 35 provided in the pattern piece 15 was obtained by a die member which opened in the opposite axial direction B. The middle portion 33 of the transfer passage 17 was provided by a partially illustrated first die member 41 which was separated from the pattern portion 13 in the axial direction A and by a partially illustrated second die member 43 which was separated from the lost foam pattern piece or portion 13 in the axial direction B.

Thus, in the past, formation of a lost foam engine block pattern with an arcuately extending transfer passage involved formation of the pattern from three pieces and also involved formation of the transfer passage in the middle piece by two die members which cooperated with each other and which were separated in opposite directions from the lost foam middle piece 13.

The invention disclosed herein is directed to simplifying this procedure.

SUMMARY OF THE INVENTION

The invention provides a lost foam pattern for an engine block including a cylinder and an axially extending transfer passage defined by spaced side walls and an inner wall which is outwardly convex, the pattern comprising a first pattern piece including a wall defining a portion of a cylindrical bore having an axis, and a passage recess extending in the direction of the axis of the cylindrical bore and communicating with the cylindrical bore, which passage recess is defined by opposed walls extending axially with respect to the cylindrical bore and forming the side walls of the transfer passage, a second pattern piece located in the passage recess, having a first arcuate wall forming a continuation of the cylindrical bore portion in the first pattern piece, having a second arcuate wall providing the inner wall of the transfer passage and being outwardly convex, and means on the first and second pattern pieces for locating the pattern pieces relative to each.

The invention also provides a lost foam pattern for an engine block including a cylinder having an axis, and an axially extending transfer passage having first and second portions, which first portion includes spaced axially extending side walls and spaced inner and outer walls connecting the side walls, which inner wall is outwardly convex and which outer wall is inwardly concave. The lost foam pattern comprises a first pattern piece including a wall defining a first portion of a cylindrical bore having an axis, a passage recess extending in the direction of the axis of the cylindrical bore and communicating with the cylindrical bore, which passage recess is defined by opposed axially extending walls at least partially forming the side walls of the transfer passage, and by a wall joining the opposed axially extending walls, being inwardly concave in a plane extending parallel to a plane extending radially from and containing the axis of the cylindrical bore, and forming the outer wall of the transfer passage, and respective pilot recesses located in each of the opposed axially extending walls, which pilot recesses open into the cylindrical bore and into the passage recess, a second pattern piece located in the passage recess and forming, with the first pattern piece, the first portion of the transfer passage, which second pattern piece has a first arcuate wall forming a continuation of the cylindrical bore portion in the first pattern piece, has a second arcuate wall forming the inner wall of the transfer passage and being outwardly convex in a plane extending parallel to a plane extending radially from and containing the axis of the cylindrical bore, has spaced walls located in the pilot recesses to locate the second pattern piece in proper position relative to the first pattern piece and to prevent movement of the second pattern piece relative to the first pattern piece except in a direction opposite to the direction of assembly of the first and second pattern pieces, and a third pattern piece including a wall defining a second portion of the cylindrical bore and a second recess communicating with the second portion of the cylindrical bore and forming the second portion of the transfer passage.

The invention also provides a lost foam pattern for an article including a main cavity and a secondary cavity defined by spaced said walls and an additional wall which is convex, said pattern comprising a first pattern piece including a wall defining a primary recess forming the main cavity and extending in a given direction, and a secondary recess extending in the given direction and communicating through the wall with the primary recess, which secondary recess is defined by opposed walls extending in the given direction and forming the spaced side walls of the secondary cavity, a second pattern piece located in the secondary recess, having a first arcuate wall forming a continuation of the wall defining the primary recess in the first pattern piece, and having a second convexly arcuate wall forming the additional wall of the secondary cavity, and means on the first and second pattern pieces for locating the first and second pattern pieces relative to each other.

Other features and advantages of the invention will become apparent to those skilled in the art upon review of the following detailed description, claims, and drawings.

THE DRAWINGS

Figure 1:
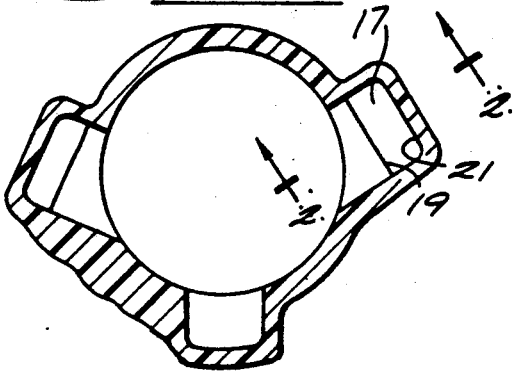
Fig. 1 PRIOR ART
FIG. 1 is a partially schematic cross sectional view of a prior art lost foam engine block which included an arcuately extending transfer passage.
Figure 2:
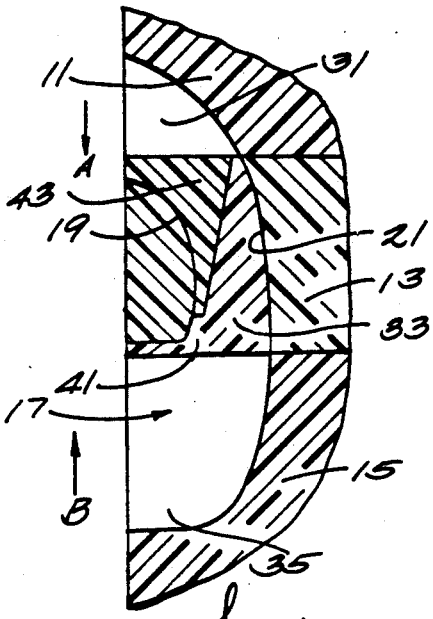
Fig. 2. PRIOR ART
FIG. 2 is an enlarged fragmentary sectional view taken along line 2—2 of FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 3:
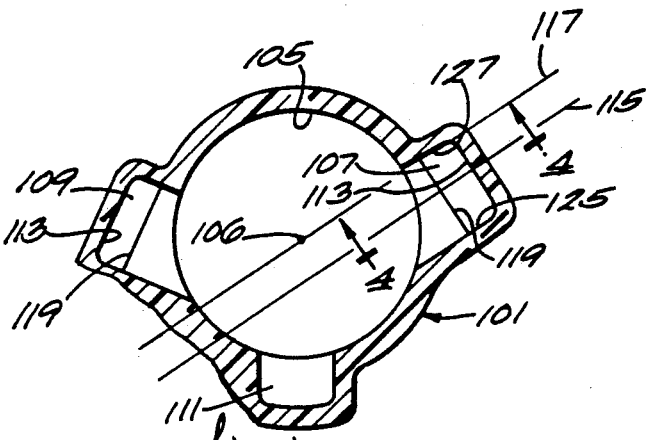
FIG. 3 is a partially schematic cross sectional view of a lost foam engine block pattern which includes an arcuately extending transfer passage formed in accordance with various of the features of the invention.

The lost foam engine block pattern 101 shown in FIG. 3 includes a cylindrical wall or bore 105 having an axis 106 and two arcuately spaced and arcuately extending, generally identical, transfer passages 107 and 109, as well as a boost transfer passage 111. Each of the transfer passages 107 and 109 extends arcuately, i.e., includes an outer axially extending arcuate wall or surface 113 which is inwardly concave in cross section. Specifically, the arcuate wall or surface 113 forming the transfer passage 107 is inwardly concave in cross section in a plane 115 extending parallel to a plane 117 extending radially through and containing the axis 106 of the cylindrical bore. In addition, each of the transfer passages 107 and 109 includes an inner axially extending arcuate wall or surface 119 which is outwardly convex. Specifically, the arcuate wall or surface 119 of the transfer passage 107 is outwardly convex in cross section in the plane 115 which extends parallel to the plane 117 extending radially from and containing the axis 106 of the cylinder bore 105. In addition, each of the transfer passages 107 and 109 includes spaced axially extending side walls 125 and 127 which connect the outer and inner arcuate walls 113 and 119 to complete the transfer passages. As the transfer passages 107 and 109 are formed in substantially identical fashion, only the construction of the transfer passage 107 will be referred hereinafter.

Figure 4:
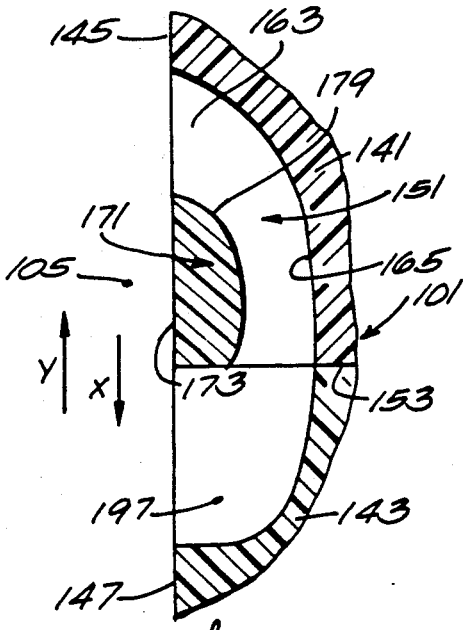
FIG. 4 is an enlarged fragmentary sectional view taken along line 4—4 of FIG. 3.

More particularly, as shown in FIG. 4, the lost foam engine block pattern 101 includes three portions or pieces, including two axially adjacent pieces 141 and 143 which are die cast of foam material, which are respectively referred to hereinafter as the first and third pieces, which are glued or otherwise fixed to each other, and which respectively include cylindrical walls 145 and 147 forming portions of the cylindrical bore 105. In addition, the first or end piece or portion 145 contains a transfer passage recess or cavity 151 which opens into the cylindrical wall 145 and into a surface 153 which mates with the third piece 143.

Figure 5:
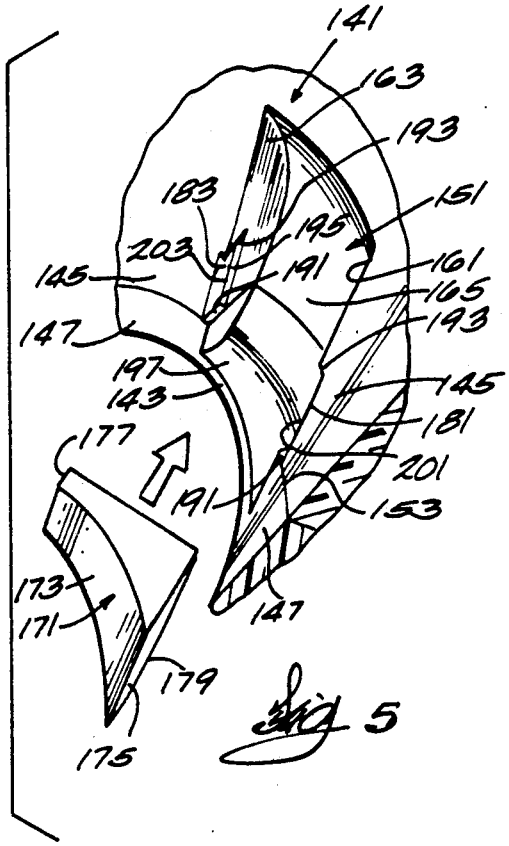
FIG. 5 is an exploded perspective view of a part of the lost foam engine block pattern shown in FIGS. 3 and 4.

As shown best in FIG. 5, the transfer passage recess or cavity 151 includes spaced and opposed axially extending walls 161 and 163 which, in part, form the side walls 125 and 127 of the transfer passage 107. In addition, the transfer passage recess or cavity 151 includes an arcuate outer wall 165 which forms the outer wall 113, and which is radially inwardly concave in cross section in the plane 115 which extends parallel to the plane 117 extending radially from and containing the axis 106 of the cylindrical bore 105. The transfer passage recess or cavity 151 can be formed by a die member (not shown) which is separated from the cast lost foam pattern piece 141 in the axial direction X.

Located in the transfer passage recess or cavity 151 is another or second pattern piece or portion 171 which is also die cast of foam material. The second pattern piece or portion 171 includes an arcuate wall 173 which forms a continuation of the cylindrical wall 145 partially defining the cylindrical bore 105, a spaced arcuate wall 179 which forms the inner wall 119 of the transfer passage 107 and which, in the assembled pattern 101, is outwardly convex in the plane 115 which extends parallel to the plane 117 extending radially from and containing the axis 106 of the cylindrical bore 105. In addition, the second pattern piece 171 includes two side walls 175 and 177 which respectively engage the walls 161 and 163 of the transfer passage recesses or cavity 151.

Means are provided for locating the second pattern piece or portion 171 in the transfer passage recess or cavity 151 in proper position and for preventing movement of the second pattern piece or portion 171 relative to the first pattern piece or portion 141, except in the direction opposite to the direction of assembly of the second pattern piece or portion 171 to the first pattern piece or portion 141. While other arrangements can be employed, in the disclosed construction, the pattern pieces 141 and 171 are assembled by relative movement therebetween in a single assembly direction in the plane 115 which is parallel to the plane 117 extending radially from and containing the axis 106 of the cylindrical bore 105, and preferably in a direction perpendicular to the axis 106 of the cylindrical bore 105.

While other constructions can be employed, in the disclosed construction, such locating means and movement preventing means comprises, in each of the wall portions 161 and 163 of the transfer passage recess or cavity 151 in the pattern piece 141, respective pilot recesses 181 and 183 which open into the cylindrical bore 105 and into the transfer passage recess or cavity 151 and which respectively receive the side walls 175 and 177 of the third pattern piece or portion 171 in inter-fitting engagement to prevent movement between the pattern pieces 141 and 171 in all directions except the direction opposite to the assembly direction. In this regard, it is noted that each of the pilot recesses 181 and 183 includes axially spaced surfaces 191 and 193 which serve to axially properly locate the pattern pieces 141 and 171 and to prevent relative axial movement therebetween. In addition, the pilot recesses 181 and 183 also includes axially extending surfaces 195 which serve to properly radially locate the pattern pieces 141 and 171 relative to each other and to prevent radially relative movement of the pattern pieces 141 and 171. Still further, the side walls 175 and 177 of the pattern piece 171 mate with the recessed surfaces 201 and 203 of the pilot recesses 181 and 183 in the walls 161 and 163 to prevent relative angular movement between the pattern pieces 141 and 171 about the axis 106 of the cylindrical bore 105.

Any suitable adhesive glue or other suitable means can be employed to fixedly attach the pattern piece 171 within the transfer passage recess or cavity 151 of the pattern piece 141 and to prevent relative movement of the pattern pieces 141 and 171 in the direction opposite to the direction of assembly.

The third pattern piece or portion 143 includes, in addition to the cylindrical wall 147, a cavity or recess 197 which forms another portion of the transfer passage and which accommodates separation from a die member (not shown) movable relatively thereto in the axial direction Y.

With the disclosed construction, the portion of the transfer passage previously provided in the upper and middle portions of the assembled pattern as disclosed in the U.S. Pat. No. 4,632,169 can be more easily manufactured and assembled. In addition, the construction disclosed herein avoids intersection or passage of a glue line through a port to the combustion chamber, and thus avoids the possibility of adverse effect on the flow through the port and into the combustion chamber due to unevenness in the casting resulting from the presence of the glue line.

Various of the features of the invention are set forth in the following claims:

I claim:

1. A lost foam pattern for an engine block including a cylinder and an axially extending transfer passage defined by spaced side walls and an inner wall which is outwardly convex, said pattern comprising a first pattern piece including a wall defining a portion of a cylindrical bore having an axis, and a passage recess extending in the direction of the axis of said cylindrical bore and communicating with said cylindrical bore, said passage recess being defined by opposed walls extending axially with respect to said cylindrical bore and forming the side walls of the transfer passage, a second pattern piece located in said passage recess, having a first arcuate wall forming a continuation of said cylindrical bore portion in said first pattern piece, and having a second arcuate wall forming the inner wall of the transfer passage and being outwardly convex, and means on said first and second pattern pieces for locating said pattern pieces relative to each other.

2. A lost foam pattern in accordance with claim 1 wherein said locating means includes respective pilot recesses located in each of said opposed axially extending walls, said pilot recesses opening into said cylindrical bore and into said passage recess, and spaced portions on said second pattern piece received in said pilot recesses to locate said second pattern piece relative to said first pattern piece and to prevent movement of said first pattern piece relative to said second pattern piece except in a direction extending radially with respect to the axis of said cylindrical bore.

3. A lost foam pattern in accordance with Claim 1 wherein said second arcuate wall of said second pattern piece is outwardly convex in a plane extending parallel to a plane extending radially from a containing said axis of said cylindrical bore.

4. A lost foam pattern for an engine block including a cylinder having an axis, and an axially extending transfer passage having first and second portions, which first portion includes spaced axially extending side walls and spaced inner and outer walls connecting said side walls, said inner wall being outwardly convex and said outer wall being inwardly concave, said pattern comprising a first pattern piece including a wall defining a first portion of a cylindrical bore having an axis, a passage recess extending in the direction of the axis of said cylindrical bore and communicating with said cylindrical bore, said passage recess being defined forming the side walls of the transfer passage, and by a wall joining said opposed axially extending walls, being inwardly concave in a plane extending parallel to a plane extending radially from and containing said axis of said cylindrical bore, and forming the outer wall of the transfer passage, and respective pilot recesses located in each of said opposed axially extending walls, said pilot recesses opening into said cylindrical bore and into said passage recess, a second pattern piece located in said passage recess and forming, with said first pattern piece, the first portion of the transfer passage, said second pattern piece having a first arcuate wall forming a continuation of said cylindrical bore portion in said first pattern piece, having a second arcuate wall forming the inner wall of the transfer passage and being outwardly convex in a plane extending parallel to a plane extending radially from and containing said axis of said cylindrical bore, and having spaced walls located in said pilot recesses to locate said second pattern piece in proper position relative to said first pattern piece and to prevent movement of said second pattern piece relative to said first pattern piece except in a direction opposite to the direction of assembly of said first and second pattern pieces, and a third pattern piece including a wall defining a second portion of said cylindrical bore and a second recess communicating with said second portion of said cylindrical bore and forming the second portion of the transfer passage.

5. A lost foam pattern for an article including a main cavity and a secondary cavity defined by spaced side walls and an additional wall which is convex, said pattern comprising a first pattern piece including a wall defining a primary recess forming the main cavity and extending in a given direction, and a secondary recess extending in said given direction and communicating through said wall with said primary recess, said secondary recess being defined by opposed walls extending in said given direction and forming the spaced side walls of the secondary cavity, a second pattern piece located in said secondary recess, having a first arcuate wall forming a continuation of said wall defining said primary recess in said first pattern piece, and having a second convexly arcuate wall forming the additional wall of the secondary cavity, and means on said first and second pattern pieces for locating said first and second pattern pieces relative to each other.

6. A foam pattern for forming a cylinder block of a two cycle engine, said pattern comprising a foam engine block component having an internal generally cylindrical wall defining a cylinder, a recess disposed in said wall and extending longitudinally of said cylinder, said recess having a base portion spaced radially from said wall and having a discharge end, a separate foam insert disposed circumferentially across said recess, said insert being spaced from said base portion to provide a longitudinal transfer passage therebetween, a first end of said insert being spaced longitudinally from said discharge end of said recess to provide a transfer port providing communication between said cylinder and the transfer passage, and means for joining said insert to said block component.

7. An evaporable polymeric foam pattern for forming a cylinder block of a two cycle engine, comprising an evaporable foam engine block component having an internal generally cylindrical wall defining a cylinder and having a head end and having an open opposite crankcase end, recess means disposed in said wall and extending longitudinally of said cylinder, said recess means having a base portion spaced radially from said wall and having a discharge end spaced from said head end, a separate evaporable foam insert disposed circumferentially across said recess means, said insert being spaced from said base portion to provide a longitudinal transfer passage therebetween, a first end of said insert being spaced longitudinally from said discharge end of said recess means to provide a transfer port providing communication between said cylinder and the transfer passage, and means for joining said insert to said block component.

8. The pattern of claim 7, wherein said means for joining said insert to said block component comprises a layer of adhesive.

9. The pattern of claim 7, wherein the inner surface of said insert is curved and forms an extension to said wall.

10. A foam pattern for forming a cylinder block of a two-cycle engine in a lost foam casting process, comprising an evaporable foam engine block component having an internal generally cylindrical wall defining a cylinder and having a head end and having an open opposite crankcase end, at least one recess disposed in said wall and extending longitudinally of said cylinder, said recess having a base portion spaced radially from said wall and having a generally curved discharge end spaced from said head end and having an opposite end opening at the crankcase end of said block component, a separate evaporable foam insert disposed circumferentially across said recess, said insert being spaced from said base portion to provide a longitudinal transfer passage therebetween, a first end of said insert being spaced longitudinally from said discharge end of said recess to define a transfer port providing communication between said cylinder and said transfer passage, and a layer of adhesive joining said insert to said block component.

11. The pattern of claim 10, wherein said insert has a second end opposite said first end and spaced longitudinally of the crankcase end of said block component.

12. A method for casting, in a lost foam casting process, an engine block including a cylinder and an axially extending transfer passage defined by spaced side walls and an inner wall which is outwardly convex, said method comprising the steps of providing a lost foam pattern comprising a first pattern piece including a wall defining a portion of a cylindrical bore having an axis, and a passage recess extending in the direction of the axis of said cylindrical bore and communicating with said cylindrical bore, said passage recess being defined by opposed walls extending axially with respect to said cylindrical bore and forming the side walls of the transfer passage, a second pattern piece located in said passage recess, having a first arcuate wall forming a continuation of said cylindrical bore portion in said first pattern piece, and having a second arcuate wall forming the inner wall of the transfer passage and being outwardly convex, and means on said first and second pattern pieces for locating said pattern pieces relative to each other, and utilizing said foam pattern in a lost foam casting process to form an engine block.

13. A method for casting a cylinder block for a two cycle engine in a lost foam casting process, said method comprising the steps of providing a foam pattern comprising a foam engine block component having an internal generally cylindrical wall defining a cylinder, a recess disposed in said wall and extending longitudinally of said cylinder, said recess having a base portion spaced radially from said wall having a discharge end, a separate foam insert disposed circumferentially across said recess, said insert being spaced from said base portion to provide a longitudinal transfer passage therebetween, a first end of said insert being spaced longitudinally from said discharge end of said recess to provide a transfer port providing communication between said cylinder and the transfer passage, and means for joining said insert to said block component, and utilizing said foam pattern in a lost foam casting process to form an engine block.

* * * * *